US005485832A

United States Patent [19]

Joffity

[11] Patent Number: 5,485,832

[45] Date of Patent: Jan. 23, 1996

[54] FACE GEAR FOR DIVING AND SWIMMING

[76] Inventor: Ricardo Joffity, Mail Box No. 7638, Sobradinho-DF-73-001-970, Brazil

[21] Appl. No.: 205,209

[22] Filed: Mar. 3, 1994

Related U.S. Application Data

[63] Continuation of Ser. No. 922,726, Jul. 31, 1992.

[51] Int. Cl.[6] ..... B63C 11/16

[52] U.S. Cl. ..... 128/201.11; 128/201.18; 128/206.21; 128/206.29

[58] Field of Search ..... 128/201.11, 201.18, 128/206.21, 206.29, 207.12, 207.14, 207.15, 207.16, 207.17, 911

[56] References Cited

U.S. PATENT DOCUMENTS

| | | | |
|---|---|---|---|
| 1,445,010 | 2/1923 | Feinberg | 128/201.18 X |
| 1,695,170 | 3/1926 | Burdick | 128/207.12 |

FOREIGN PATENT DOCUMENTS

| | | | |
|---|---|---|---|
| 736745 | 9/1932 | France | 128/201.11 |
| 143839 | 8/1903 | Germany | 128/201.11 |
| 299010 | 11/1919 | Germany | 128/201.18 |
| 699841 | 1/1939 | Germany | 128/201.18 |
| 754529 | 4/1954 | Germany | 128/201.18 |
| 2047545 | 12/1980 | United Kingdom | 128/201.18 |

*Primary Examiner*—Edgar S. Burr
*Assistant Examiner*—William J. Deane, Jr.

[57] ABSTRACT

In a first embodiment, a bilateral snorkel apparatus is shown. The bilateral snorkel consists of two tubes connected to a user's mouthpiece at one end and to each other at opposite ends at the back of the user's head. Lateral movement of the snorkel tubes is thus avoided by virtue of the increased rigidity of the tube arrangement. Lateral movement of the mask is also avoided by virtue of connecting the two tubes at the back of the user's head. In a second embodiment, a switchable mouth/nose breathing system is also disclosed. Switching between the mouth and nose is accomplished through a mouth operated hydraulic bladder which enables nose bladders/pads to close the user's nostrils. In a third embodiment, a hydraulically activated valve is illustrated for switching air circulation respectively between the mouth, the nose or for allowing combined mouth/nose breathing.

2 Claims, 4 Drawing Sheets

FIG. 1
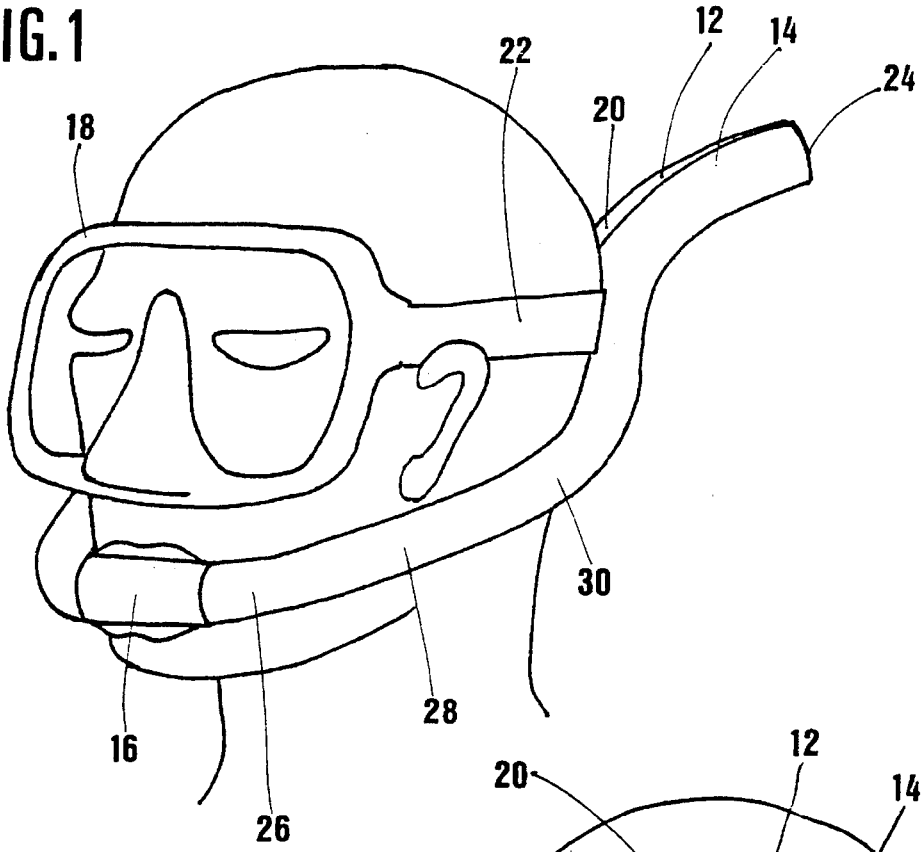
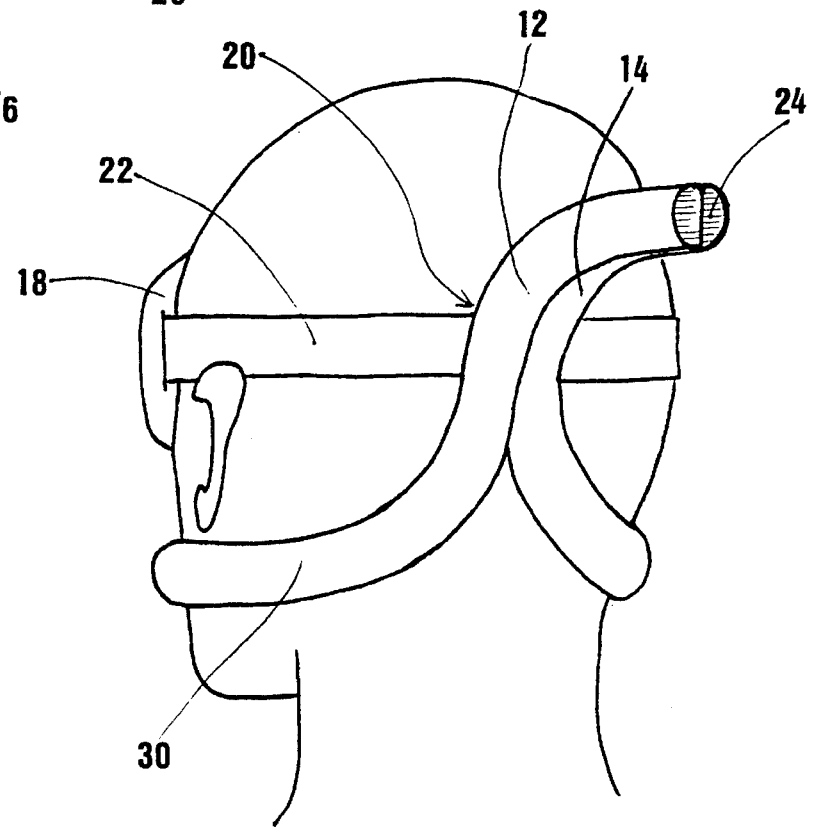
FIG. 2

FACE GEAR FOR DIVING AND SWIMMING

This application is a continuation of application Ser. No. 07/922,726, filed Jul. 31, 1992.

FIELD OF THE INVENTION

The present invention relates to face gear equipment for use in diving and swimming.

DESCRIPTION OF RELATED ART

Most diving and swimming equipment for underwater breathing have the common disadvantage of not allowing the user to breathe through his nose. By having to breathe through the mouth, swimmers are at a severe disadvantage with respect to maintaining their nostrils closed while breathing in a natural manner to receive and exhale oxygen. Moreover, if the user's nostrils are not closed, excess pressure on the eustachion tube can cause excess pressure buildup and can, in turn, cause strain and stress on the tympanic membrane. As a result, swimmers and divers often suffer severe ear pain.

A further drawback to many available systems is that they rely upon the use of a snorkel which is connected to one side of the face mask, usually along the face mask strap. A sudden motion, such as that caused by surface wave movement, can result in excess pulling on the strap. As a result, water may enter the face mask.

Furthermore, current systems do not easily enable a user to either breathe through their nose or their mouth. To the extent that some divers can manually close their nostrils, no system is available which allows a user to close their nostrils without using their hands. As a result, the user is able to maneuver without using their hands to compensate for external pressure on the tympanic nerves so that during a dive their hands are free to function while they may continuously compensate for the external pressure on the membrane. Moreover, no system exists that allows air into the mask in order to compensate for increasing external pressure on that mask. Thus, systems do not exist which reduce stress on the diver due to poor pressure distribution to the users' mouth and nose. As a result, problems such as otitis, an inflammation of the ear, or sinusitis, an inflammation of the sinus membrane, may result.

SUMMARY AND OBJECTS OF THE INVENTION

In view of the foregoing, it should be apparent that there exists a need in the art for an apparatus for diving and swimming which avoids the above-noted problems and provides the user with an ability to breathe through his nose and not have to use their hands to close their nostrils to depressurize the eustachion tubes, and not rely on any lateral positioning of the snorkel so as to avoid getting water in the mask. It is, therefore, a primary object of the invention to provide a face gear for diving and swimming by using a bilateral snorkel arrangement having a mouthpiece with a valve and tube connected to the mask and which contains a mechanism for closing the user's nostrils.

More particularly, it is an object of the invention to provide face gear for diving and swimming which includes a snorkel having two symmetrical sides each of which are adapted to fit around a swimmer's head to meet at an opposite end of the swimmer's head in order to avoid excess pressure on one side of the swimming mask.

Another object of the invention is to provide a mouthpiece having a tube connected to the mask in order that both mouth and nose breathing can be accomplished in a simply constructed, easy to use device.

Yet another object of the invention is to provide a mouthpiece having a hydraulic system controlled by a user's teeth so that mouth/nose breathing can be controlled without the use of the diver's hands.

It is yet a further object of the invention to provide a swimming and diving mask having a nostril closing arrangement which is activated without the use of a diver's hands.

It is yet a further object .of the invention to provide a nostril closing arrangement comprising a pair of hydraulically activated elements which respectively are pressurized/depressurized through a diver's/swimmers' teeth.

Briefly described, these and other objects of the invention are accomplished by providing a pair of symmetrically disposed breathing tubes which curve around the sides of the user's head and meet at the back of that user's head in order to provide a stable yet flexible breathing arrangement that is not laterally shifted. The mouthpiece is connected to the breathing tube and contains a switching means for opening or closing air passages respectively to the swimmer's mouth or nose. As a result, the user may swim and selectively block air or provide air intake/extake between the nose and mouth without having to use his or her hands to close his nostrils.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

FIG. 1 is a perspective view of a bilateral snorkel arrangement arranged on a diver's head;

FIG. 2 is a perspective view of the back of the diver's head having the bilateral snorkel arrangement, as shown in FIG. 1;

FIGS. 5A–5C are top cutaway views, while FIG. 5D is a perspective side view of a first embodiment of the nostril closing device using inflatable cushions;

DETAILED DESCRIPTION OF THE PREFERRED EMBODIMENT

Figure 3:
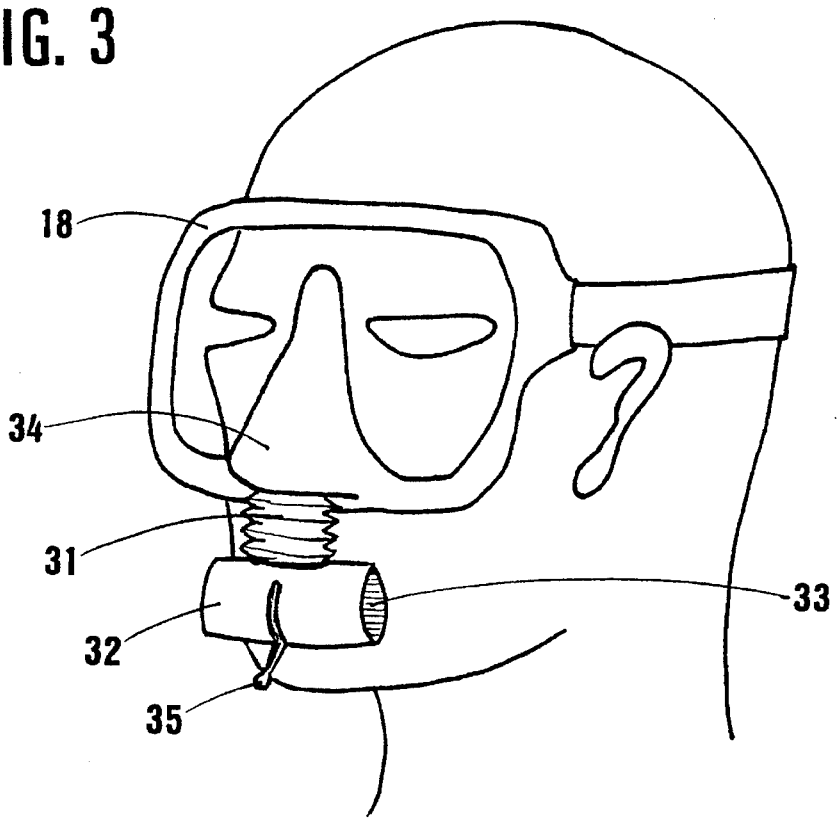
FIG. 3 is a perspective view of a diver's head using a first embodiment of the mouthpiece arrangement of the present invention with a valve.

Referring now in detail to the drawings wherein like parts are designated by like reference numerals throughout, there is illustrated in FIG. 1 a side perspective view of the bilateral snorkel arrangement 10 used in conjunction with a standard face mask 18. In particular, the bilaterial snorkel consists of two curved tubes 12 and 14 which are respectively connected to each side of a mouthpiece member 16. The tubes are oriented so that they curve along the user's maxillary underneath that user's ears, up along the neck and the back of the head to meet at a point 20 behind the user's head. At point 20, the tubes are respectively fixed to a belt 22 holding the face mask in place. The backs of the tubes 12 and 14 are oriented so that they extend substantially vertically when a swimmer is in the water. As a result, the air openings 24 in both tubes extend substantially vertically above the water by several inches.

The tubes are curved in such a manner that they first sweep substantially backwards along a first curve 26 from each side of the user's mouth to a point along their cheeks 28. From point 28 to point 30, which occurs approximately behind the user's ears, each tube is relatively straight. From point 30, the tubes respectively meet point 20. The overall configuration of the tubes are semicircular from a top view.

The tube arrangement, therefore, provides a breathing apparatus which does not pull the strap 22 except at the back of the user's head. As a result, the face mask 18 will not be laterally shifted to one side of the user's face and water seepage into the user's mask is thus minimized. Additionally, due to the increased stability caused by the use of two tubes fixed together at point 20, surface wave motion is not imparted to the snorkel. As a result, an accidental intake of water due to a substantial downward shift of the tube, is avoided. Finally, a swimmer does not have to use his or her hands in order for him to clamp extra hard on mouthpiece 16 in order to retain the breathing tubes in place.

FIG. 3 illustrates a first embodiment of the mouthpiece arrangement 30 of the present invention. In particular, a mouthpiece 32 is shown, which is valve operated (not shown), in order that a user may selectively breathe either through his nose and/or mouth. As shown, the mouthpiece 32 is connected to a face mask 18 through its nose portion 34. The connection tube 31 can be, for example, ribbed tubing so that relative movement between the nose and the mouth can be compensated for through expansion or contraction of the ribbed tube 31. The mouthpiece 32 further includes an air intake valve 35 which will be described in more detail below.

An opening on either side of the mouthpiece is shown as tube 33 which can be connected to the bilateral snorkel as shown in FIGS. 1 or 2. Alternatively, the mouthpiece can be connected to an air tank or any other appropriate device that supplies air/oxygen for swimming/scuba diving purposes. The valve shown in FIG. 3 is intended to avoid the situation in which water gets into the mask through the nose and windpipe during a dive. The valve, as shown in this figure, can be controlled by use of a hydraulic system or by a switch mounted on the cylinder (not shown).

Figure 4:
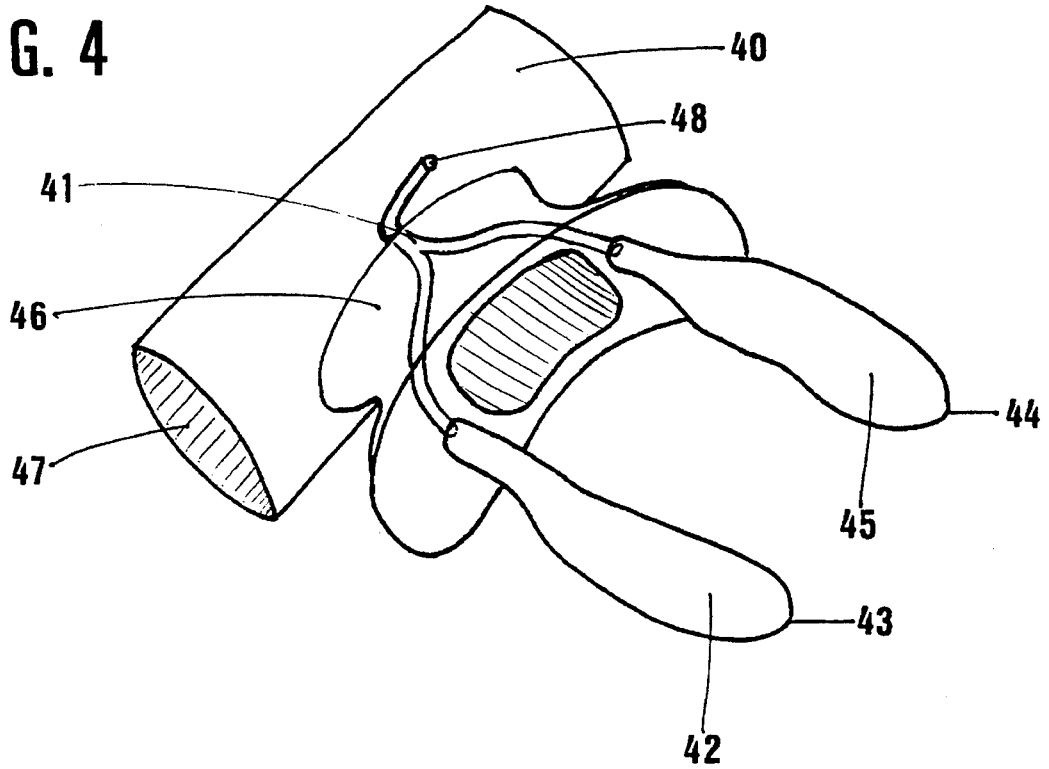
FIG. 4 is a side perspective view showing the mouthpiece used in conjunction with the common mouthpiece in FIG. 3.

FIG. 4 illustrates a hydraulic system used in conjunction with the mouthpiece arrangement shown in FIG. 3. In particular, FIG. 4 illustrates a mouthpiece arrangement 40 employing two hollow flexible bladders 43 and 44, respectively. Each hollow bladder is designed so that it can expunge fluid when pressed by a user's teeth or tongue. The system is also designed to receive fluid when switched to a rest position. As shown, the mouthpiece arrangement consists of a mouthpiece body 46 containing an air passage 47. The mouthpiece contains internal tubulation 41 which respectively connects bladders 43 and 44 having internal hollow chambers 42 and 45 so that those bladders are in fluid communication. The internal tubulation connects the two bladders to a single exit tube 48 which respectively leads through the ribbed windpipe tube 31 to the nose piece 34 (FIG. 3). Through this arrangement, hydraulic pressure is provided through the bladders 43 and 44 and tube 48 to actuate a nose clamping device (described below).

Figure 5A:
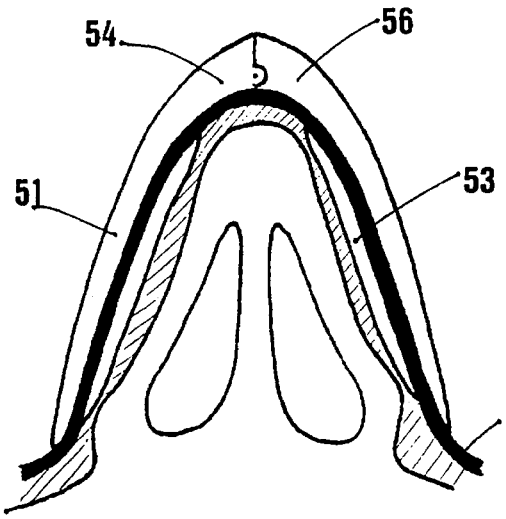
Figure 5B:
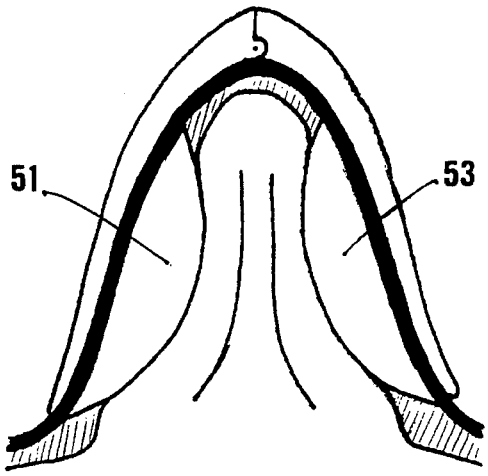
Figure 5C:
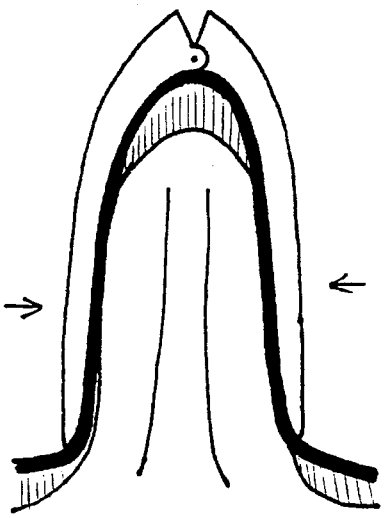
Figure 5C:
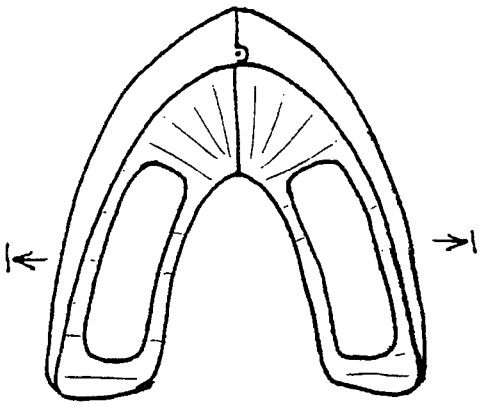
Figure 6A:
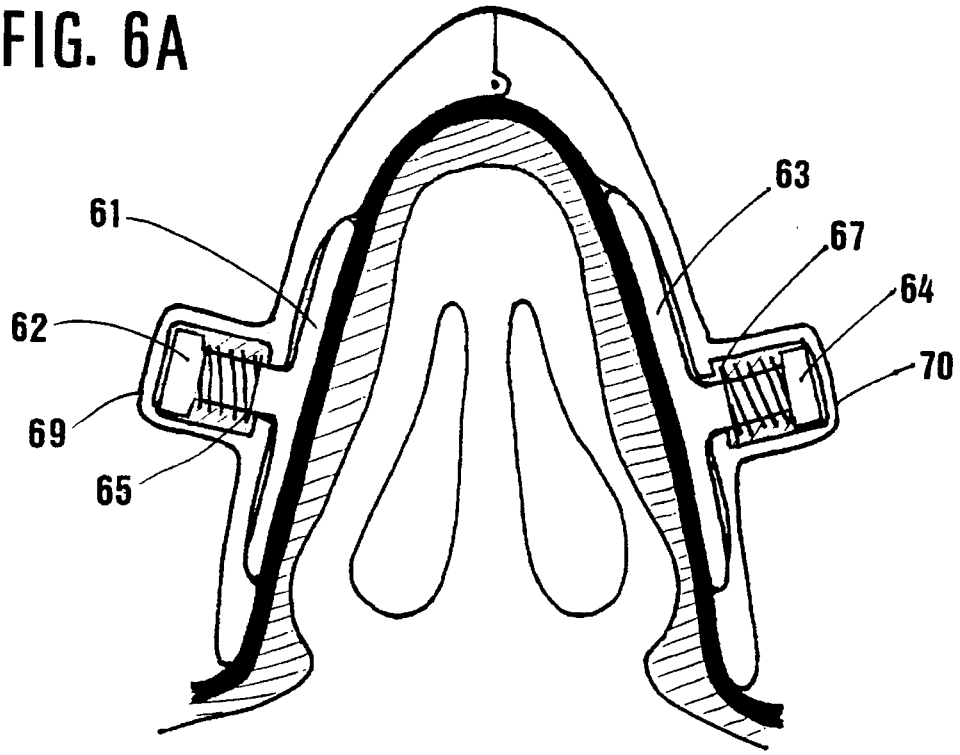
FIGS. 6A–6B are top cutaway views of a second embodiment of the nostril closing devices using hydraulic driven arms.
Figure 6B:
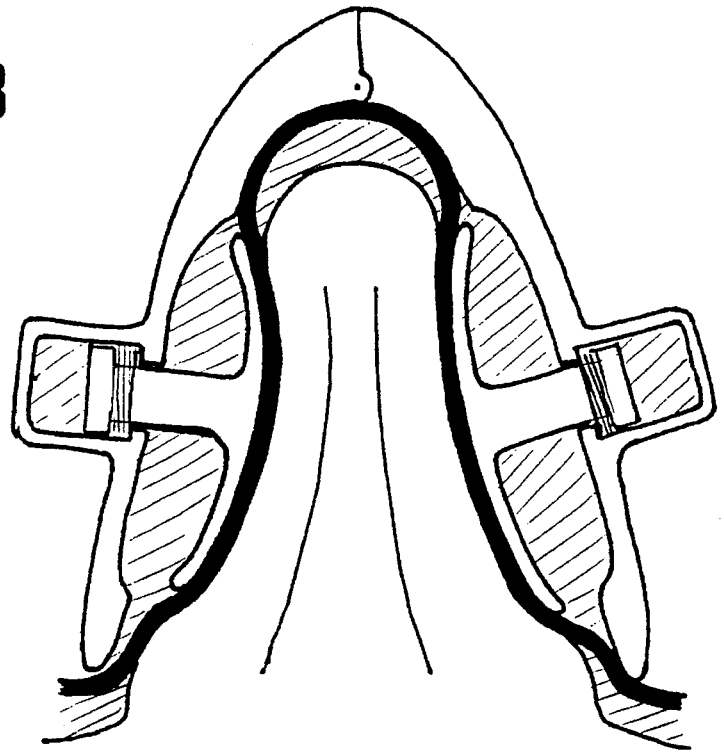

The apparatus for clamping a swimmer's nostrils using the pressurized fluid from hydraulic system 40 is shown respectively in FIGS. 5A–5D, or in a second embodiment, in FIGS. 6A–6B.

Referring now to FIGS. 5A–5D, a first embodiment of the nostril closing device is shown in cross-section. The first embodiment 50 is based upon using a pair of expandable bladders 51 and 53 to pinch nostrils together and to thus block air into and out of the nose. The bladders 51, 53 are supported on a shell formed from two semi-rigid plastic arms 54 and 56. Both arms are generally formed in the shape of a user's nose. The shell is in turn contained within an outer plastic membrane layer 34 rendering it impermeable to water. The shell is hinged to close towards the user's nose. The shell hinge also limits how far the shell can open outwardly. As a result, the shell allows the arms 54 and 56 to be pressed in by hand if necessary while expansion of the bladders results in only limited outward movement. Attached to the inside portions of arms 54 and 56 are two flexible bladders 51 and 53 which are positioned respectively on both sides of the user's nostrils. Each of the bladders is connected to the water tube 48 (not shown) so as to be in fluid communication with the bladders 43 and 44. Upon pressing down on the bladders 43 and 44 hydraulic fluid is pressurized and is caused to flow up through the tube 48 to expand bladders 51 and 53 around user's nose. The user's nostrils are thus effectively closed by the bladders 51 and 53 (see FIG. 5B). FIG. 5D illustrates the shell in perspective view that contains the bladders and openings for the tubing.

A second embodiment 60 of the nostril pressurizing device is shown in FIGS. 6A and 6B. The second embodiment 60 relies on the same operational principals i.e., hydraulic actuation/deactuation, to expand/contract members to pinch closed a user's nostrils. The nostril closing device (FIG. 6D) employs two flat cushions 61,63 which are driven by a pair of spring-loaded pistons 62,64 located on each side of the nose. The pistons include springs 65,67, pistons 62,64 and cylinders 69,70 which are in fluid communication with tube 48 connected to the bladders 43,44. In use, the swimmer depresses bladders 43,44 with her teeth which forces fluid to flow up through the tube 48 and which in turn increases pressure in the cylinders in 69,70. The cylinders 69 70 thus pressurized cause the pistons 63,64 and attached cushion pads 61,63 to slide towards the nose. Springs 65,67 bias the pads 61,63 to slide away from the nostrils when the fluid pressure is reduced.

In operation, when the user presses bladders 43,44 as shown in FIG. 4, the tube 48 is filled with water so that the bladders expand or the cushion pads slide, to pinch the nostrils together. The water tube 48 can be inserted into the mask nose through a conic socket (not shown). When teeth pressure on the bladders 43,44 decreases or is removed, the nostrils can open. One advantage of this arrangement is that air can be blown into the mask to compensate for external pressure on the mask itself. Another advantage of this arrangement is that the nostril closing apparatus can be used in conjunction with a diver's efforts at equalizing pressure in the eustachion tubes. Moreover, the device can be used with comfort. That is because pressing teeth together is something that a person must naturally do to pressurize the eustachian tubes.

In order to open air passages to the nose, the bladder 45 is depressed causing fluid to enter into the fluid flow passage 89. The increased fluid pressure causes spring 88 to extend in the direction of arrow 91. As a result, the opening 84 is rotated towards wind pipe tube 31 so that air, contained in large cylinder 86, can be inhaled through the wind pipe tube 31. The medium hollow bladder 43, in turn, enables an operator to breathe both through the nose and through the mouth. Nose and mouth breathing can thus be rapidly switched without requiring the diver/swimmer to use her hands. The instant invention also allows the system to compensate for pressure inside the mask so that pressure can be increased or decreased accordingly. Finally, the instant valve arrangement allows the user to quickly pressurize his/her eustachion tubes in order to avoid damage to the tympanic membrane.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A diving face gear comprising:

a face mask having an enclosed nose covering;

a breathing tube connected to an air source;

a mouthpiece connected to said breathing tube;

a wind pipe tube connected to said nose covering and to said mouthpiece; and switching means for selectively allowing or not allowing fluid connection through said wind pipe tube enabling a user either to breath through said mouthpiece and through said nose covering at the same time or to breath exclusively through said mouthpiece avoiding water entrance to said nose covering;

an actuator consisting of a water filled pair of bladders appended to said mouthpiece and designed to fit inside a user's mouth so that a user can depress said bladders with the teeth causing water to be expelled from said bladders or release teeth pressure causing water to enter said bladders;

a pipe connecting said bladders through said mouthpiece to a single external connection tube; and nose clamping means controlled by said actuator.

2. The diving face gear of claim 1 wherein said nose clamping means comprises:

a pair of flat bladders fixed to each side of said nose covering;

a pipe connecting said flat bladders through said nose covering to a single external socket to which can be adapted the connection tube of said actuator so that said pair of flat bladders fills with water and expands around a user's nose clamping it as said actuator is depressed and releasing as said actuator is released.

* * * * *

UNITED STATES PATENT AND TRADEMARK OFFICE

CERTIFICATE OF CORRECTION

PATENT NO. : 5,485,832

DATED : Jan. 23, 1996

INVENTOR(S) : Ricardo Joffily

It is certified that error appears in the above-identified patent and that said Letters Patent is hereby corrected as shown below:

On title page, item [19] , should read --Joffily--
item [76], should read --Ricardo Joffily--

Signed and Sealed this

Fifth Day of November, 1996

*Attest:*

Bruce Lehman

BRUCE LEHMAN

*Attesting Officer*

*Commissioner of Patents and Trademarks*